US006893316B2

(12) United States Patent
Maxwell et al.

(10) Patent No.: US 6,893,316 B2
(45) Date of Patent: May 17, 2005

(54) TOYS WITH MECHANICAL INTERACTION AND METHOD OF USING THE SAME

(75) Inventors: Matthew C. Maxwell, East Aurora, NY (US); Jeffrey A. Brown, Hamburg, NY (US); Anthony A. Morley, Stillwater, MN (US)

(73) Assignee: Mattel, inc., El Segundo, CA (US)

( * ) Notice: Subject to any disclaimer, the term of this patent is extended or adjusted under 35 U.S.C. 154(b) by 0 days.

(21) Appl. No.: 10/431,585

(22) Filed: May 8, 2003

(65) Prior Publication Data

US 2004/0259466 A1 Dec. 23, 2004

(51) Int. Cl.[7] ..... A63H 31/00; A63H 33/04

(52) U.S. Cl. ..... 446/103; 446/246

(58) Field of Search ..... 446/102, 103, 446/236, 246

(56) References Cited

U.S. PATENT DOCUMENTS

| | | | | |
|---|---|---|---|---|
| 949,544 | A | | 2/1910 | Muehlstein |
| 1,294,446 | A | | 2/1919 | Greenstreet |
| 1,615,925 | A | | 1/1927 | Yancey |
| 1,977,496 | A | | 10/1934 | Snyder et al. |
| 2,338,803 | A | | 1/1944 | Donofrio |
| 2,649,803 | A | | 8/1953 | Andre |
| 2,919,476 | A | | 1/1960 | Fritz |
| 3,049,814 | A | | 8/1962 | McLain |
| 3,144,731 | A | | 8/1964 | Jones et al. |
| 3,162,978 | A | | 12/1964 | Balthazor |
| 3,236,004 | A | | 2/1966 | Christiansen |
| 3,415,007 | A | | 12/1968 | Howe |
| 3,475,849 | A | | 11/1969 | Fischer |
| 3,488,880 | A | | 1/1970 | Taylor |
| 3,510,979 | A | | 5/1970 | Fischer |
| 3,566,530 | A | | 3/1971 | Fischer |
| 3,638,352 | A | | 2/1972 | Christiansen |
| 3,768,175 | A | | 10/1973 | Hill et al. |
| 3,881,274 | A | * | 5/1975 | Kanda ..... 446/103 |
| 3,921,348 | A | | 11/1975 | Kurzen |
| 3,961,439 | A | | 6/1976 | Moustakas |
| 3,965,610 | A | * | 6/1976 | Den Ouden ..... 446/103 |
| D251,993 | S | | 5/1979 | Birdsall |
| 4,508,348 | A | * | 4/1985 | Lapointe ..... 273/157 R |
| D280,219 | S | | 8/1985 | Suzuki |
| 4,619,625 | A | | 10/1986 | Seki et al. |
| 4,696,655 | A | | 9/1987 | D'Andrade et al. |
| 4,798,555 | A | | 1/1989 | Schaub et al. |
| D302,444 | S | | 7/1989 | Tapdrup et al. |
| 4,897,066 | A | | 1/1990 | Tapdrup et al. |
| 5,041,048 | A | | 8/1991 | Lehmann et al. |
| 5,411,428 | A | | 5/1995 | Orii et al. |
| 5,427,558 | A | | 6/1995 | Knudsen et al. |
| D391,999 | S | | 3/1998 | Chininis |
| 5,890,943 | A | * | 4/1999 | Poulsen et al. ..... 446/103 |
| 6,132,281 | A | | 10/2000 | Klitsner et al. |
| 6,162,108 | A | | 12/2000 | Frederiksen |
| 6,585,553 | B1 | | 7/2003 | Fetridge et al. |

FOREIGN PATENT DOCUMENTS

| | | |
|---|---|---|
| DE | 3737521 A1 | 5/1989 |
| EP | 0 045 526 B1 | 9/1981 |
| EP | 0 192 802 A2 | 9/1986 |
| FR | 1 296 091 | 5/1962 |
| GB | 2 037 596 A | 7/1980 |
| GB | 2 267 041 A | 11/1993 |

(Continued)

*Primary Examiner*—Jonn A. Ricci
(74) *Attorney, Agent, or Firm*—Cooley Godward LLP

(57) ABSTRACT

A toy item includes a body with a drive, a drive input, a drive output, and a driven activity member, or other movable output. Application of force to the drive input can activate the drive and produce movement of the driven activity member. Two similar toy items can be disposed in operable engagement so that the drive output of one toy item can engage the drive input of the other toy item, so that application of force to the drive input of one toy item can activate the drives of both toy items.

34 Claims, 7 Drawing Sheets

FOREIGN PATENT DOCUMENTS

| | | |
|---|---|---|
| IT | 647020 | 10/1962 |
| JP | 1-126297 | 8/1989 |
| WO | WO 03/057336 A1 | 7/2003 |

* cited by examiner 301
300
331
302
360
341
335
336
336
338
340
350
343
302
342
344
305
309

TOYS WITH MECHANICAL INTERACTION AND METHOD OF USING THE SAME

BACKGROUND OF THE INVENTION

This invention relates generally to toy items, and more particularly to toy blocks that interact with other toy blocks.

Toy blocks are generally known. Toy blocks may provide a user with entertainment and have educational value. A user may stack or otherwise assemble toy blocks and the blocks may have letters, numbers or other educational figures located thereon.

The need exists for toy blocks that provide mechanical interaction between blocks when the blocks are stacked or otherwise connected. Also, a need exists for a drive mechanism for driving a number of drives with a single actuator when a number of toys are stacked or otherwise connected.

SUMMARY OF THE INVENTION

A toy item, which may be a toy block, has an activity member or other movable entertainment device that can be actuated by a drive internal to the toy item. A drive input disposed on or within the block can be actuated by a user to operate the drive and actuate the activity member is activated, providing entertainment for a user. The toy item includes a drive output coupled to the drive and is configured so that a substantially similar toy item can cooperate with the toy item so that when the drive input of one toy item is actuated, the drive output of the toy item in turn actuates the drive input of the other toy item.

DETAILED DESCRIPTION

The invention includes at least one toy item, and may include multiple toy items that may interact with one another. In one embodiment, the toy items are toy blocks. The toy blocks include an input device which permits mechanical energy to be transferred from one toy block to another toy block to produce output at via an activity member on each of the respective items simultaneously.

Figure 1:
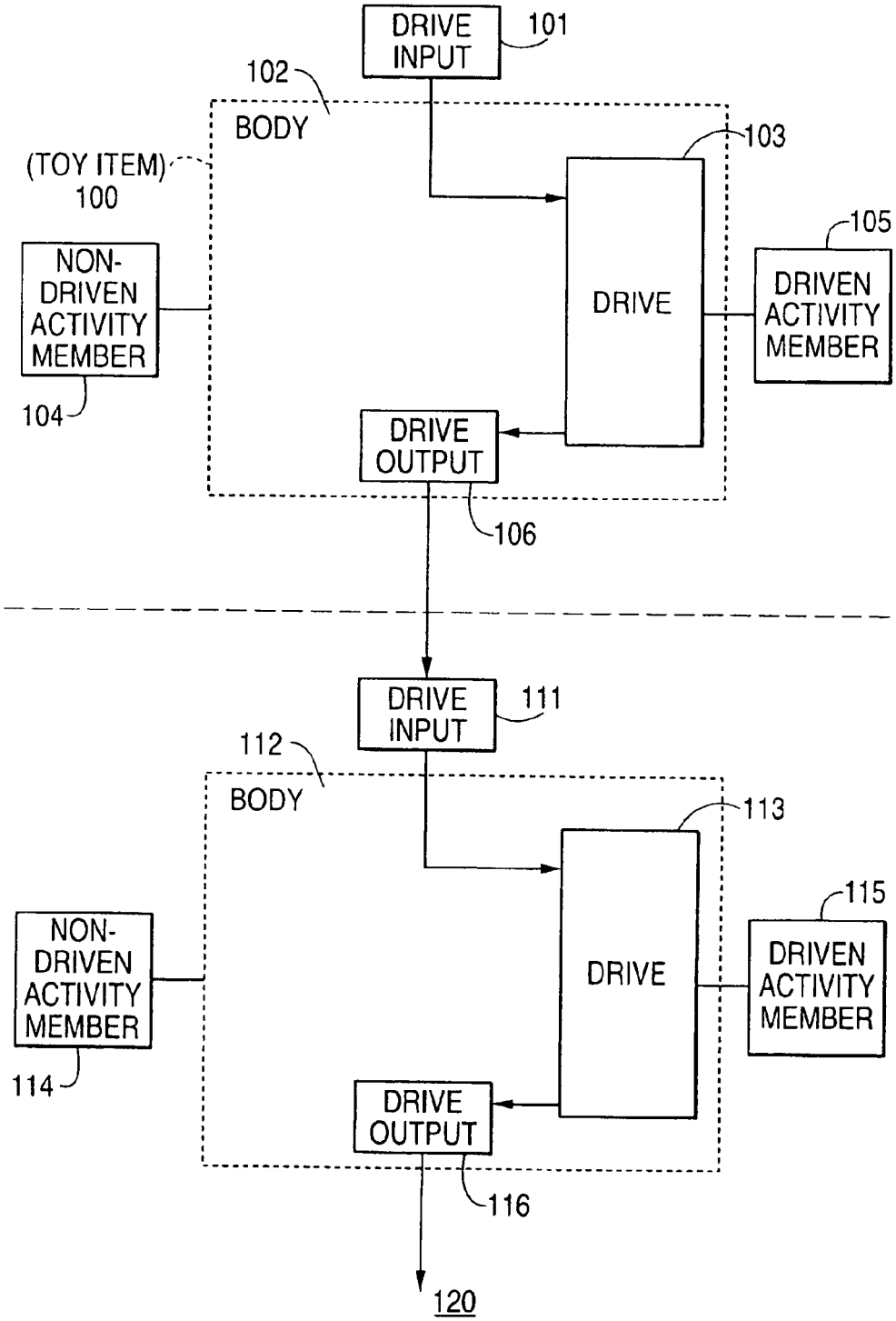
FIG. 1 is a schematic block diagram of a toy item embodying the principles of the invention.

The functionality of two similar toy items incorporating the principles of the invention is illustrated schematically in FIG. 1. Two toy items, 100 and 110, are shown in FIG. 1. Each of toy item 100 and toy item 110 has a body to which is mounted, or within which is contained, a drive input, a drive mechanism, one or more driven and non-driven activity members, and a drive output. The drive output of one toy item can interact with the drive input of the other toy item.

Toy item 100 thus includes a body 102. A drive 103 is mounted within body 102. A drive input 101 is mounted to body 102 so as to be accessible from outside body 102 and is operably coupled to drive 103. A user (or another toy item, as explained below) can apply an input force to drive input 101, which in turn initiates operation of drive 103. Toy item 100 also includes a driven activity member 105, mounted in or to body 102 and operably coupled to drive 103. Toy item 100 may also include one or more additional non-driven activity members 104, which are not coupled to drive 103 and which therefore are separately activated, such as by application of force directly by a user. Toy item 100 also includes a drive output 106, mounted to body 102 so as to be accessible from outside body 102 and operably coupled to drive 103.

Application of a force to drive input 101 activates drive 103, which in turn activates driven activity member 105 and drive output 106.

Toy item 110 has structure similar to toy item 100, and thus includes a body 112, a drive 113, a driven activity member 115, a non-driven activity member 114, and a drive output 116. Toy item 110 also operates similarly to toy item 100—application of a force to drive input 111 activates drive 113, which in turn activates driven activity member 115 and drive output 116.

Toy items 100 and 110 can interoperate, so that activation of the drive of one of the toy items can in turn activate the drive of the other toy item. Thus, the drive output of each toy item is configured to cooperate with the drive input of the other (or any other similarly-configured) toy item so that the force applied to the drive input of one toy item is transmitted (at least in part) via the drive and drive output to the drive input of the other toy item.

Figure 2:
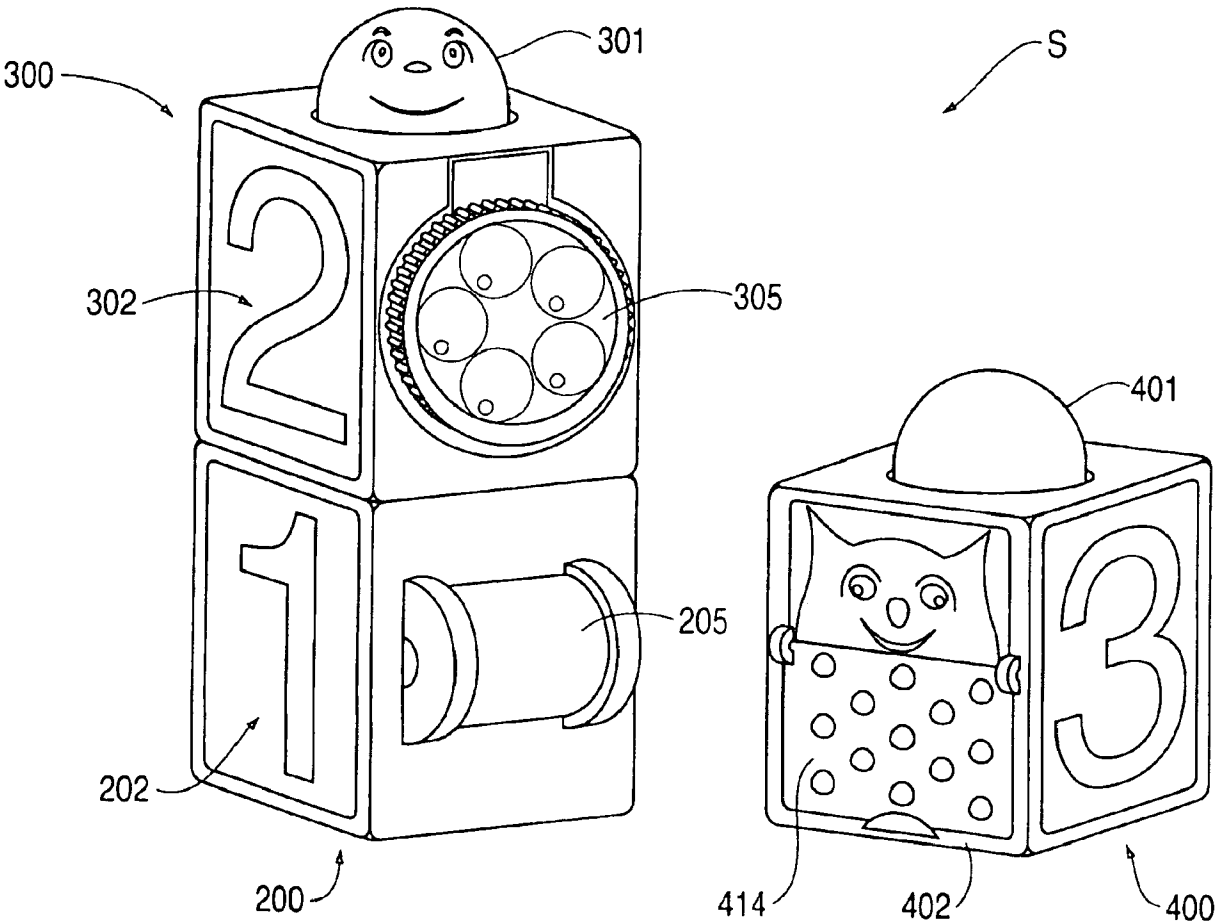
FIG. 2 illustrates a front perspective view of three toy items embodying the principles of the invention.

Several embodiments of toy items embodying the principles of the invention illustrated schematically above are described below. FIG. 2 illustrates a set S of toy items, 200, 300 and 400, each resembling a toy block. The elements visible in FIG. 2 for these toy items include the bodies 202, 302, 402, drive inputs 301, 401, driven activity members 205, 305, and non-driven activity member 414.

Figure 3A:
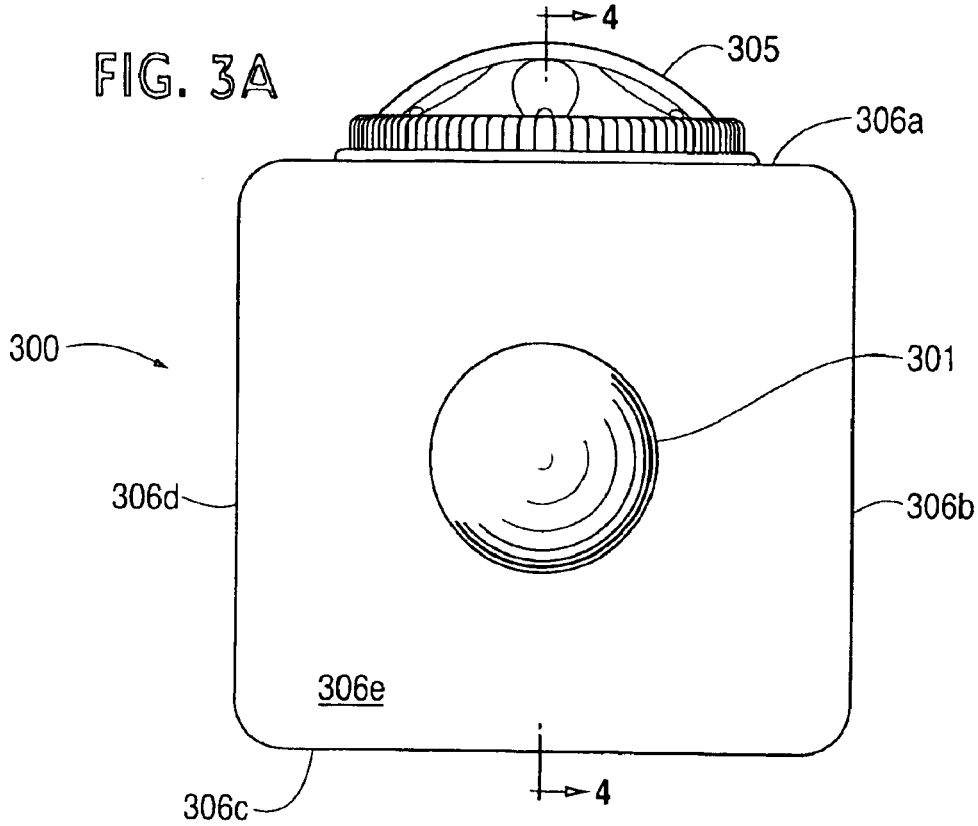
FIGS. 3A and 3B are a top and bottom views of one of the toy items of FIG. 2.
Figure 3B:
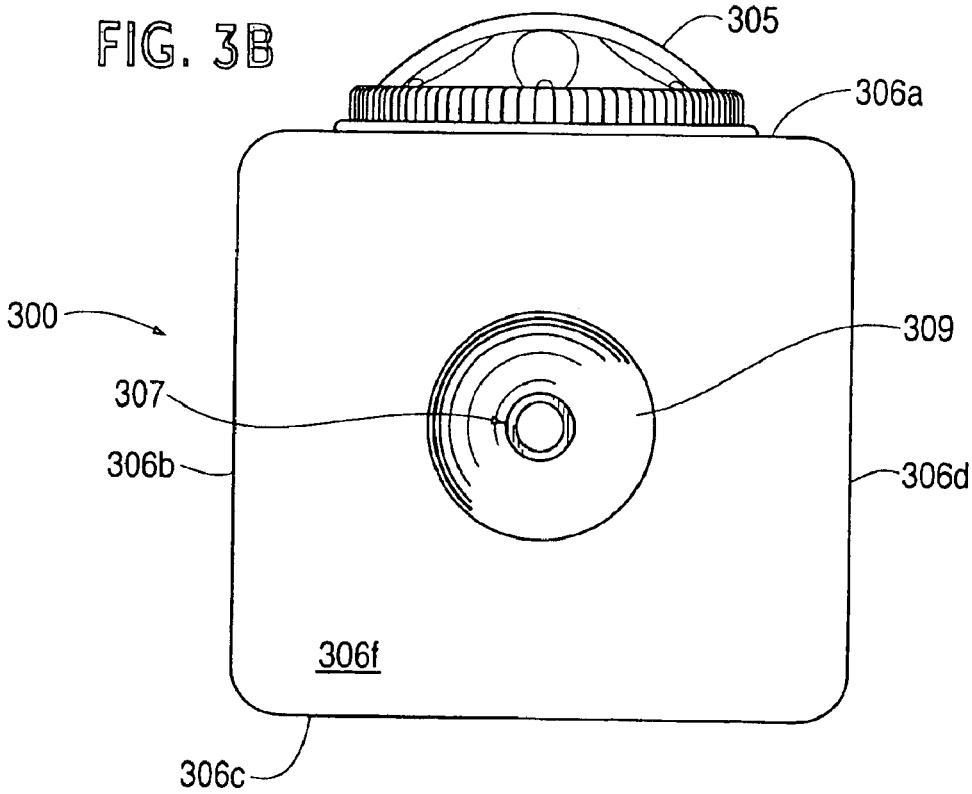

Toy item 300 is described and illustrated below in more detail below with reference to FIGS. 2–5. As shown in FIGS. 2, 3A, and 3B, toy item 300 has an generally cubic body 302 with four side faces 306*a*, 306*b*, 306*c*, and 306*d*, top face 306*e*, and bottom face 306*f*. Driven activity member 305 is disposed on side face 306*a* and non-driven activity member 314 (See FIG. 4) is disposed on side face 306*c*. Graphical indicia, such as numbers, letters, etc., are disposed on side faces 306*b*, 306*d*. Drive input 301 projects from upper face 306*e*, while drive output 307 is received in a recess 309 in bottom face 306*f*.

Figure 4A:
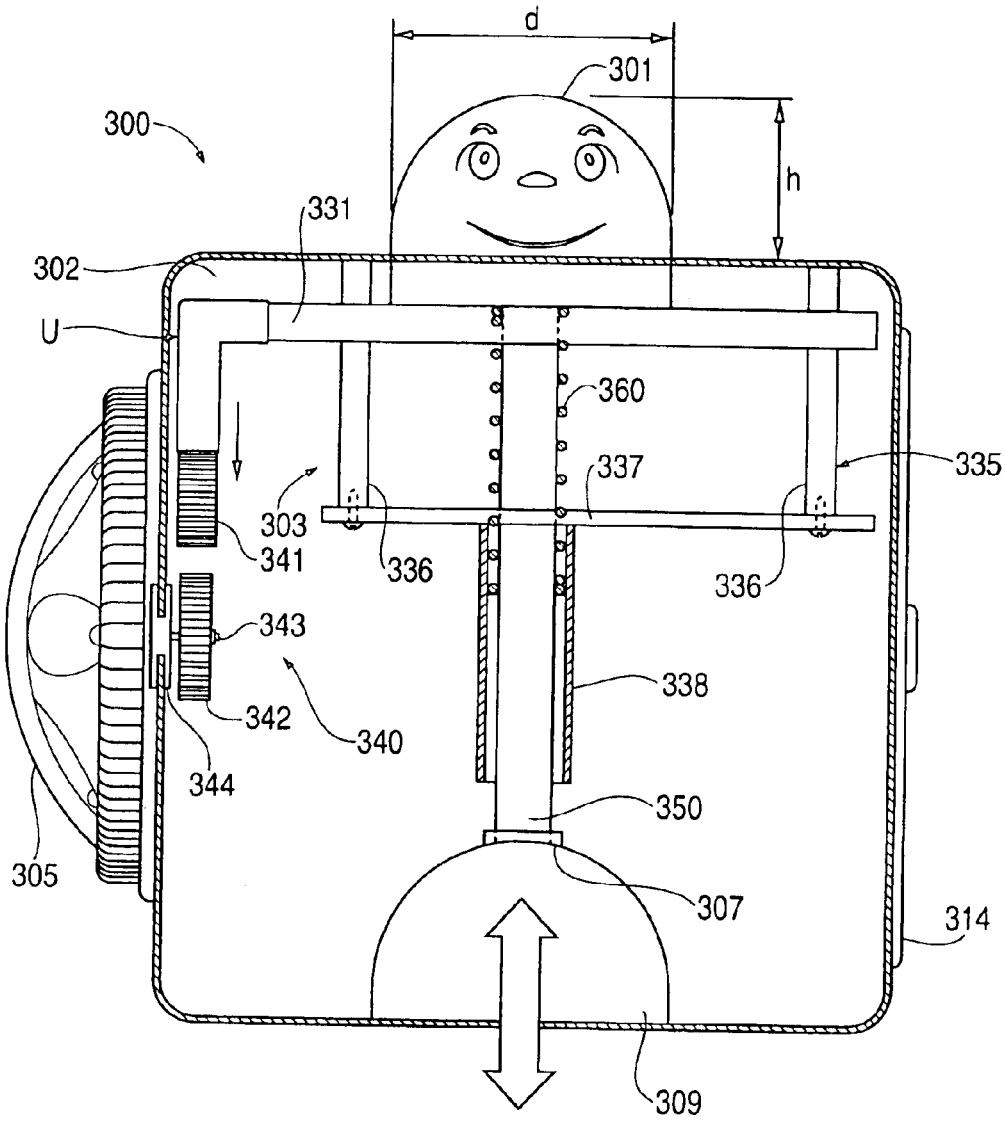
FIG. 4A is a partial cross-sectional side view of the toy item of FIG. 3A, taken along line "4—4", when the drive is in an inactivated position.
Figure 4B:
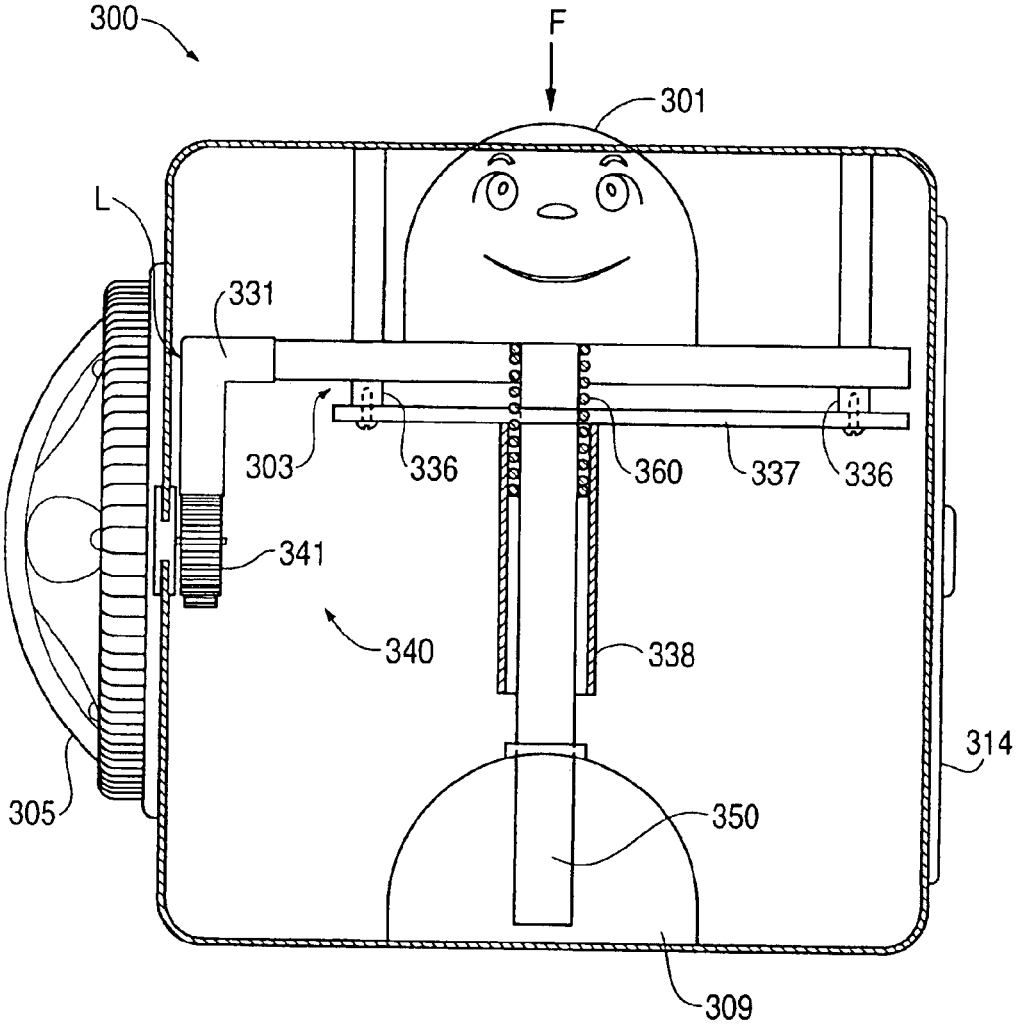
FIG. 4B is a partial cross-sectional side view of the toy item of FIG. 3A, taken along line "4—4," when the drive is in an activated position.
Figure 5:
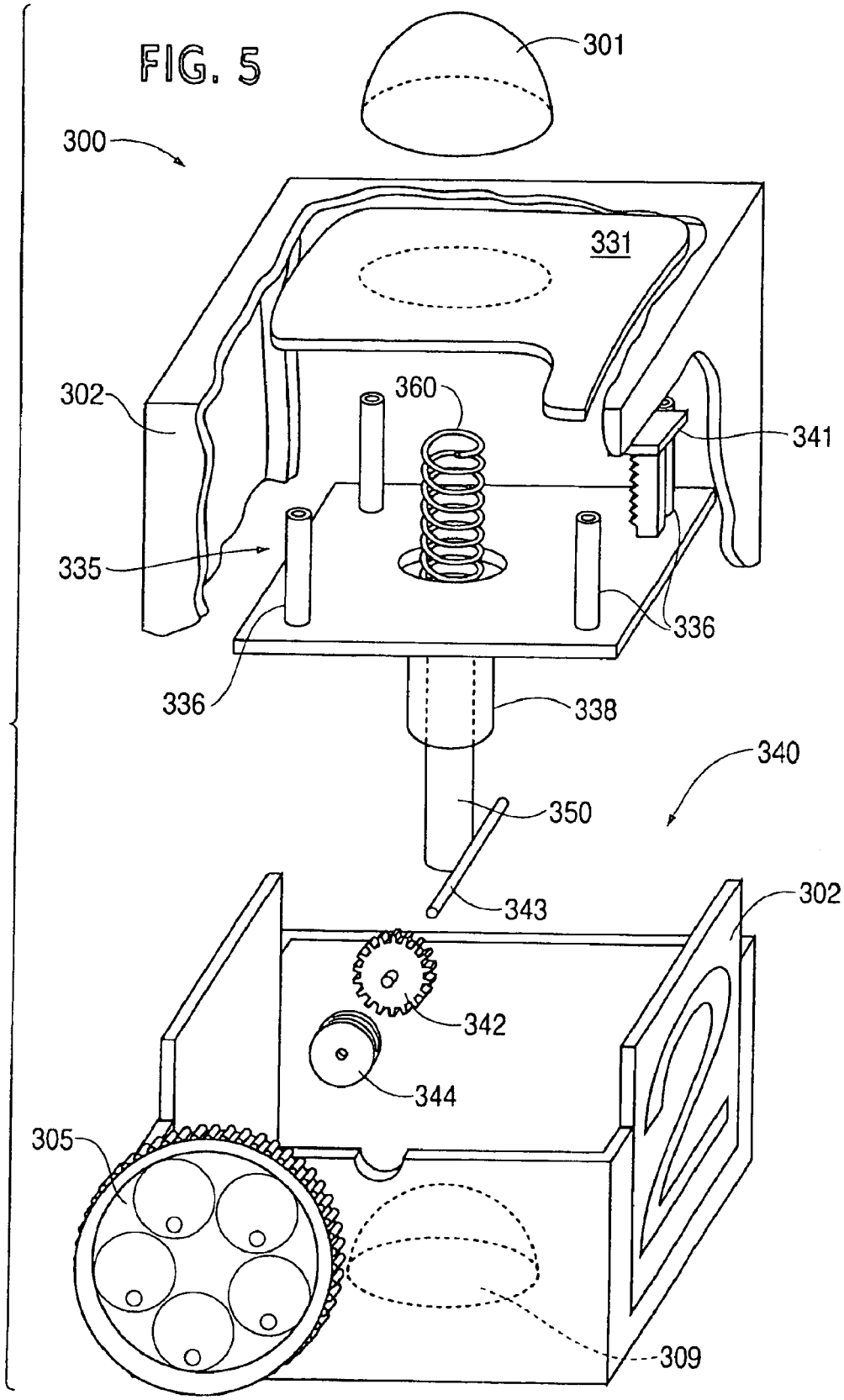
FIG. 5 is an exploded perspective view of the toy item of FIG. 3B.

Drive 303 and its interaction with drive input 301, drive output 307, and driven activity member 305, are illustrated in FIGS. 4A, 4B, and 5. Drive 303 includes a connection or interface with each of drive input 301 and drive output 307 and a drive train or other operative coupling with driven activity member 305. In the illustrated embodiment, drive 303 also includes (but need not include) a biasing member to urge the drive to a non-activated or rest position. Drive 303, drive input 301, and drive output 307 all operate with a reciprocating, linear translational motion.

In the disclosed embodiment, drive 303 includes a drive plate 331, a guide structure 335, a drive post 350, an activity member drive 340, and a biasing member 360, such as a spring. Drive plate 331 is a generally flat plate, with a coupling on its upper side to receive drive input 301. Guide structure 335 includes a set of bosses 336 depending from the upper portion of body 302, a guide plate 337 coupled to the lower ends of bosses 336, and a guide tube 338 that depends downwardly from guide plate 337. Drive post 350 is mounted to (or formed integrally with) drive plate 331 and projects downwardly through guide tube 338. The edges of drive plate 331 also engage the sides of bosses 336 when the drive plate 331 slides relative to the guide structure 335. Guide structure 335 thus functions to constrain guide the vertical, reciprocal motion of drive 303 along a linear range of motion between an upper, rest, or non-activated position "U" (shown in FIG. 4A) and a lower or activated position "L", as shown in FIG. 4B. Spring 360 is disposed around drive post 350 and bears at its lower end against the upper side of guide plate 337 and at its upper end against the lower side of drive plate 331. Spring 360 thus serves to bias drive plate 331 (and its attached structures) upwardly towards upper position "U."

Drive output 307 is formed by the lower end of drive post 350. As shown in FIGS. 4A and 4B, when drive 303 is in position "U", drive output 307 is at the top of recess 309, whereas when drive 303 is in position "L," drive output 307 protrudes into recess 309 by approximately the same distance as the height "h" of drive input 301 (which is approximately the amount by which drive input 301 is displaced between position "U" and position "L" of drive 303).

The activity member drive 340 includes a rack 341 depending from an extension of drive plate 331, a circular gear 342, an axle 343, and a positioner 344. Gear 342 is positioned on axle 343, which is mounted for rotation with respect to body 302. When drive 303 is in the non-activated position "U", as depicted in FIG. 4A, rack 341 may be spaced apart from gear 342. When drive 303 is in the activated position "L", as shown in FIG. 4B, rack 341 engages gear 342 (not shown). Rack 341 may be formed integrally with the drive plate 331 or may be separable from the drive plate 331.

When the drive 303 is in activated position "L", spring 360 biases the drive plate 331 away from guide plate 337, and thus biases drive 303 towards the non-activated position "U." When force "F" is removed from drive input 301, drive 303 is urged back towards position "U," rotating gear 342 and thus axle 343. As rack 341 disengages the gear 342, gear 342 and axle 343 continue to rotate.

In this embodiment of toy item 300, driven activity member 305 is a disk with a clear dome enclosing an inner, mirrored, and dimpled dome, with colored balls disposed in the dimples of the inner dome. The disk is attached to axle 343 to rotate with respect to body 302.

As illustrated in FIGS. 4A and 4B, toy item 300 may also include a non-driven activity member 314. Activity member 314 may a conventional "flap" device in which one of two graphic indicia is selectively exposed by moving a horizontally-pivoted flap between an upper and a lower position (such as is shown in FIG. 2 on toy item 400).

In the illustrated embodiment, drive input 301 is generally hemispherical in shape, and protrudes a distance "h" from upper face 306*e* of body 302 when in the upper, non-activated position and has a diameter "d." Recess 309 in bottom face 306*f* of body 302 is also generally hemispherical in shape and has a diameter slightly larger than "d" and a height slightly greater than "h." Thus, recess 309 can accommodate a drive input of another toy item of the same size of drive input 301. The upper and lower faces 306*e* and 306*f*, and the drive input 301 and drive output 306 are thus complementary to each other, in that identical toy items can be stacked atop each other with the drive output of one toy item engageable with, and able to actuate, the drive input of the other toy item.

Figure 6:
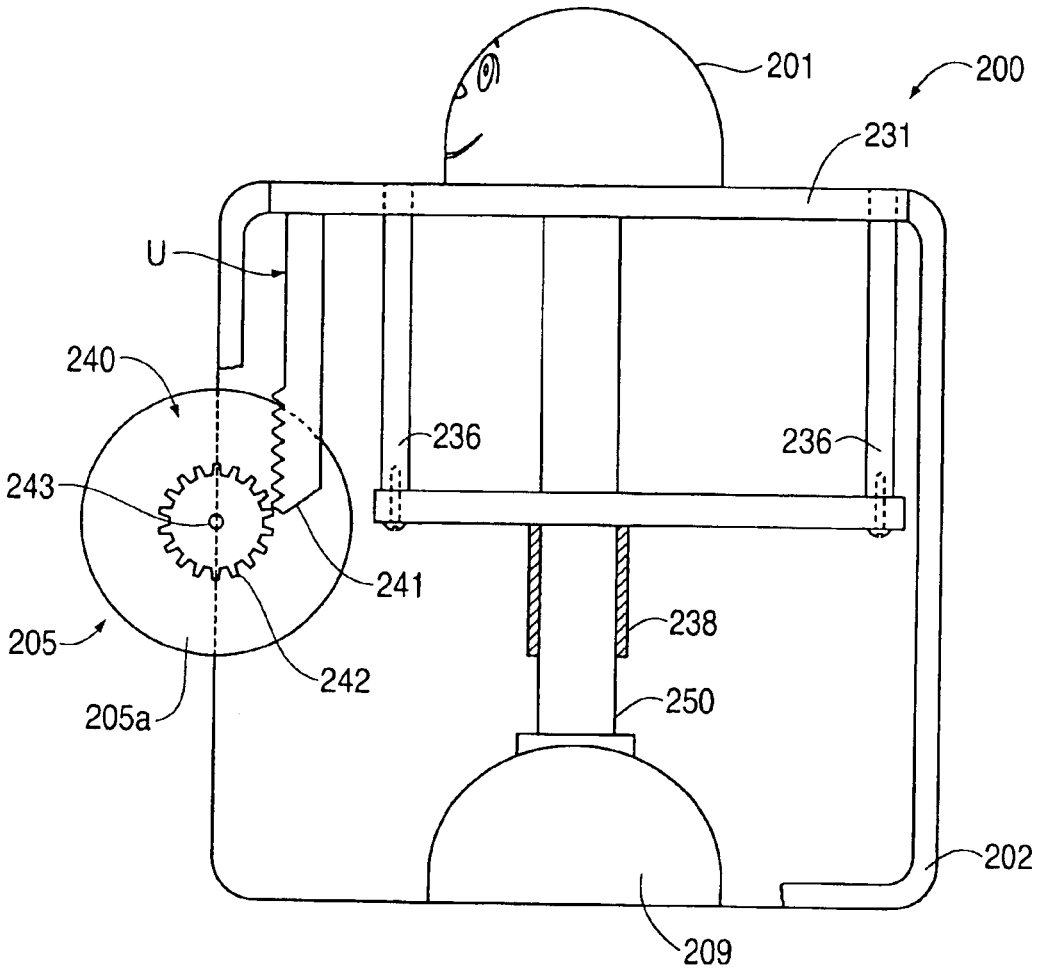
FIG. 6 is a partial cross-sectional side view of another of the toy items of FIG. 2.

Another embodiment of a toy item incorporating the principles of the invention, toy item 200, is illustrated in FIG. 6 in partial cross-section. Toy item 200 has many features in common with toy item 300, and therefore only the differences between the activity member drive 240 and the driven activity member 205 and the corresponding structures of toy item 300 will be described.

Toy item 200 includes a driven activity member 205 that includes a cylindrical drum 205*a* that rotates with respect to the body 202 of the toy item 200 about an axis parallel to a side face of toy item 200 (whereas the disk of driven activity member 305 rotates about an axis perpendicular to a side face of toy item 300). Activity member drive 240 includes a rack 241 depending from drive plate 231 and a circular gear 242 mounted to an axle 243, which is journaled in body 202. Drum 205*a* is fixed to axle 243 to rotate therewith.

Similar in operation to toy item 300, a spring 260 biases drive plate 231 towards an upper or non-activated position "U". When the drive input 201 is depressed, rack 241 engages gear 242. When the force is removed from the drive input 201, a translational motion is imparted to the activity member 205, as the drive plate is biased back into position "U".

There are different ways that a user can activate any of the toy items 200, 300, 400. A user may apply on input force "F" directly to a drive input (201, 301, 401) to activate the drive and thus the driven activity member. Alternatively, a user may, for example as shown in FIG. 2, place toy item 300 on top of toy item 200, with drive input 201 disposed in recess 309. In this stacked configuration, the user may apply input force "F" to drive input 301, displacing it towards position "L." Drive output 307 will protrude into recess 309, engaging drive input 201 and urging it downwardly. Thus application of force "F" to drive input 301 will activate both drive 303 and drive 203, which in turn will activate both driven activity member 305 and driven activity member 205. When the user removes force "F" from drive input 301, springs 260 and 360 will both act to urge drives 203 and 303 back toward their respective upper positions "U", further activating the driven activity members 205 and 305.

The user could further stack one or more additional toy items onto toy item 300, with each toy item's recess disposed to accommodate another toy items' drive input. All of the stacked toy items can then be activated by application of force "F" to the drive input of the uppermost toy item.

Numerous variations on the structure and operation of the toy items disclosed above are possible. In the embodiments above, the driven activity members are driven to continuous rotational motion by the toy items' drives. A driven activity member could instead be driven to reciprocating or otherwise discontinuous rotational motion and/or to translational motion about or along one or more axes. The artisan could readily select appropriate drive train components for the toy item's drive to produce the desired motion of the driven activity member.

In the illustrated embodiments, the toy items' drives translate along an axis perpendicular to parallel faces of the cubic toy item, i.e. the drive has linear motion in which a rigid drive component (e.g. drive post 350) is guided by a linear guide, with the drive input and the drive input on opposite faces. Alternatively, a drive output could be located on a face that is not parallel to the face on which the drive input is located. This could be accomplished by any suitable mechanism readily selected by the artisan, including an arcuate guide that guides a flexible drive post, or through appropriate gearing or other drive components.

In the illustrated embodiments, each toy item includes a single driven activity member. Of course, two or more driven activity members could be disposed on or in the toy item's body and coupled to the drive.

In the illustrated embodiment, the drive of each toy item is activated by application of a force pushing inwardly toward the body of the toy item. Alternatively, the drive could be activated by a force pulling outwardly from the toy item (and the drive could be biased inwardly to a non-activated position in which the drive input does not protrude from the surface of the body). Drive input would be configured suitably, e.g. with a hook or other readily-grasped shape, rather than the hemispherical shape disclosed above. The drive output could be configured to engage appropriately with the drive input, e.g. a mating hook, a loop, etc., so that when two toy items are stacked or otherwise place in operative engagement, the drive input of one toy item is engaged with the drive output of the other toy item.

In the illustrated embodiments the toy items do not couple together—a toy item can just be rested atop another toy item. Alternatively, any of a number of known coupling mechanisms could be used to engage one toy item to another, by the surfaces of their bodies and/or by their respective drive input and drive output.

In the illustrated embodiments, hemi-spherical recesses and drive inputs are disclosed. Alternatively, they may be of any shape, including pyramidal, cubic, or any other geometrical configuration.

In the illustrated embodiments, the bodies of the toy items are cubic. Alternatively, the toy items may be of any geometrical shape, such as pyramidal, trapezoidal, rectangular, spherical or any number of other non-geometrical shapes.

The various features of the invention have been described in relation to a toy item. However, it will be appreciated that many of the features, such as the drive, activity member, and the body may also be implemented in various other configurations. Moreover, variations and modifications exist that would not depart from the scope of the invention. A number of these variations have been set forth above.

What is claimed is:

1. A toy, comprising:

a first item;

a first actuator coupled to said first item for relative translational motion between said first actuator and said first item;

a second item;

an activity member coupled to said second item; and a second actuator coupled to said second item for relative translational motion between said second actuator and said second item, said second actuator being coupled to said activity member and being configured to actuate said activity member, said first item being configured to engage said second item, said first actuator being configured to selectively engage said second actuator.

2. The toy of claim 1, wherein said activity member is a first activity member, said first item having a second activity member coupled to said first item, said first actuator being coupled to said second activity member and being configured to actuate said second activity member.

3. The toy of claim 2, wherein said second activity member is configured to rotate with respect to said first item.

4. The toy of claim 2, wherein said second activity member is configured to translate with respect to said first item.

5. The toy of claim 1, wherein said activity member is configured to rotate with respect to said second item.

6. The toy of claim 1, wherein said activity member is configured to translate with respect to said second item.

7. The toy of claim 1, wherein said second actuator has a portion configured to extend from said second item, and said first item has a recess configured to receive the portion of said second actuator when said first item engages said second item.

8. The toy of claim 7, wherein said first actuator has a portion that is configured to selectively extend from the recess of said first item to engage said second actuator.

9. The toy of claim 1, wherein said activity member is a first activity member, said second item has a second activity member coupled to said second item.

10. The toy of claim 1, wherein said activity member is a first activity member, the toy further comprising:

a third item having a second activity member coupled to said third item and a third actuator coupled to said third item for relative translational motion between said third actuator and said third item, said third actuator being coupled to said second activity member and being configured to actuate said second activity member, said second item being configured to engage said third item, and said second actuator being configured to selectively actuate said third actuator when said second item engages said third item.

11. The toy of claim 1, wherein said first item is a block.

12. The toy of claim 1, wherein said first item is a cube.

13. A toy, comprising:

a first item having a recess;

a first actuator, said first actuator being coupled to said first item for relative motion between said first actuator and said first item;

a second item having an activity member coupled to said second item; and a second actuator coupled to said second item for relative motion between said second actuator and said second item, said second actuator being coupled to said activity member and configured to actuate said activity member, said recess being configured to receive a portion of said second actuator, said first actuator being configured to selectively extend from said first item to actuate said second actuator when said portion of said second actuator is received by said recess.

14. The toy of claim 13, wherein said activity member is configured to move with respect to said second item in one of a pivotal motion, a rotational motion, and a translational motion.

15. The toy of claim 13, wherein said first item is one of a block and a cube.

16. The toy of claim 13, wherein said activity member is a first activity member, said first item having a second activity member coupled to said first item, said first actuator being coupled to said second activity member and being configured to move said second activity member with respect to said first item.

17. A toy, comprising:

a first item including a polyhedron having at least a first face, a second face, and a third face;

an activity member disposed on said first face of said first item;

an actuator disposed on said second face of said first item, said actuator configured to move said activity member with respect to said first item;

a second item configured to engage said first item, said second item including an activity member; and means coupled to said first item for selectively actuating said activity member of said second item when said second item engages said first item, said means being disposed on said third face of said polyhedron.

18. The toy of claim 17, wherein said activity member of said second item is configured to rotate with respect to said first item.

19. A toy, comprising:

a first item;

an activity member coupled to said first item;

an actuator coupled to said first item, said actuator configured to move said activity member with respect to said first item;

a second item configured to engage said first item; and means coupled to said second item for selectively actuating said activity member when said second item engages said first item, wherein said activity member is configured to translate with respect to said first item.

20. The toy of claim 19, wherein said activity member is a first activity member, said second item having a second activity member coupled to said second item.

21. A toy, comprising:

a first item;

a first activity member coupled to said first item;

a depressible actuator coupled to said first item;

a second item; and a second activity member coupled to said second item, said first item configured to engage said second item, said actuator configured to actuate said first activity member and said second activity member using a relative translational motion, when said first item engages said second item.

22. The toy of claim 21, wherein said second activity member is configured to move with respect to said second item in one of a pivotal motion, a rotational motion, and a translational motion.

23. The toy of claim 21, wherein said first item is one of a block and a cube.

24. A toy comprising:

a first block having an upper surface and a lower surface;

a first actuator disposed in said first block for reciprocal axial movement and movable between a first position in which an upper end of said first actuator extends from said upper surface of said first block and a second position in which said upper end of said first actuator is retracted below said upper surface of said first block;

a second block having an upper surface and a lower surface;

a second actuator disposed in said second block for reciprocal axial movement and movable between a first position in which an upper end of said second actuator extends from said upper surface of said second block and a second position in which said upper end of said second actuator is proximate to said upper surface of said second block; and an activity member coupled to said second block and activated when said second actuator is moved from its first position to its second position, said lower surface of said first block having a recess configured to receive said second actuator when said second actuator is in its first position, said first actuator is configured to contact and move said second actuator from its first position to its second position when said second actuator is received by said recess and said first actuator is moved from its first position to its second position.

25. The toy of claim 24, wherein said activity member is a first activity member, further comprising:

a second activity member coupled to said first block and activated when said first actuator is moved from its first position to its second position.

26. The toy of claim 24, wherein the upper end of said first actuator and the upper end of said second actuator are dome shaped.

27. The toy of claim 24, further comprising:

a first biasing member configured to bias said first actuator into its first position; and a second biasing member configured to bias said second actuator into its first position.

28. The toy of claim 24, wherein said first block and said second block are cubic.

29. The toy of claim 24, further comprising:

a connector configured to couple said first block to said second block.

30. The toy of claim 24, wherein said activity member is configured to move with respect to said second item in one of a pivotal motion, a rotational motion, and a translational motion.

31. A method of using a toy having a first item including an actuator coupled to the first item for relative motion between the actuator and the first item; and a second item including an activity member coupled to the second item for relative motion between the activity member and the second item, the method comprising:

engaging the first item with the second item;

depressing the actuator of the first item;

imparting a rotational, translational, or pivotal motion to the activity member with respect to the first item using a translational motion of the actuator of the first item; and moving the activity member.

32. The method of claim 31, wherein said engaging the first item with the second item includes inserting a portion of the second item into a recess of the first item.

33. The method of claim 31, wherein said actuating the actuator of the first item includes moving the actuator in a translational motion with respect to the first item.

34. A toy comprising:

a body having a first surface and a second surface;

a drive disposed in said body;

a drive input operably coupled to said drive, disposed to be accessible from outside said body at said first surface, and disposed for reciprocating translational motion into and out of said body;

a drive output operably coupled to said drive, disposed to be accessible from outside said body at said second surface, and disposed for reciprocating translational motion into and out of said body; and a movable activity member disposed on said body and operably coupled to said drive;

said drive configured to be activated by application of a predetermined force to said drive input and to move said movable activity member and displace said drive output;

said first surface being complementary with said second surface, and said drive input being complementary with said drive output, whereby said toy can be disposed in operable engagement with another toy having a substantially identical first surface and drive input so that activation of said drive causes said drive output to engage with the drive input of the other toy and activate the drive thereof.

* * * * *